United States Patent [19]

Allen

[11] 4,041,714

[45] Aug. 16, 1977

[54] MINE ROOF SUPPORTS

[75] Inventor: Archelaius Dawson Allen, Leyland, England

[73] Assignee: Gullick Dobson Limited, England

[21] Appl. No.: 617,108

[22] Filed: Sept. 26, 1975

[51] Int. Cl.[2] ..... E21D 15/44

[52] U.S. Cl. ..... 61/45 D; 248/357

[58] Field of Search ..... 61/45 D; 299/31, 33; 248/357; 91/170 MP

[56] References Cited

U.S. PATENT DOCUMENTS

| | | | |
|---|---|---|---|
| 3,728,863 | 4/1973 | Hidasi | 61/45 D |
| 3,739,586 | 6/1973 | Wehner et al. | 61/45 D |
| 3,837,170 | 9/1974 | Martinko et al. | 61/45 D |
| 3,903,703 | 9/1975 | Lubojatsky | 61/45 D |
| 3,908,389 | 9/1975 | Lubojatsky et al. | 61/45 D |
| 3,911,686 | 10/1975 | Becker et al. | 61/45 D |

FOREIGN PATENT DOCUMENTS

| | | | |
|---|---|---|---|
| 1,948,280 | 1/1971 | Germany | 61/45 D |

*Primary Examiner*—Dennis L. Taylor

*Attorney, Agent, or Firm*—Berman, Aisenberg & Platt

[57] ABSTRACT

The invention is concerned with a self-advancing mine roof support comprising a base, hydraulically extensible prop means mounted on said base and a roof-engaging structure, including a canopy, mounted on said prop means for application thereby to a roof to be supported. On at least one side of the roof support there is a laterally extensible and retractable auxiliary canopy and a device is provided for urging and extending said auxiliary canopy laterally outwardly with respect to the support. The auxiliary canopy on the support bears firmly against a similar auxiliary canopy on an abutment on a neighboring roof support so as to prevent roof material falling between the two supports. Because it is retractable, however, the auxiliary canopy does not interfere with the advance of the supports. Conveniently the auxiliary canopy comprises two box-like members fitted telescopically one within the other. The device for urging and extending the auxiliary canopy laterally may be a pressure-fluid ram, and valve means controlling the pressure-fluid flow of said ram may be incorporated in the pressure-fluid system of a pressure-fluid advancing means for the support so that said ram is automatically retracted or put on open circuit before said advancing means becomes operative to advance the support.

18 Claims, 9 Drawing Figures

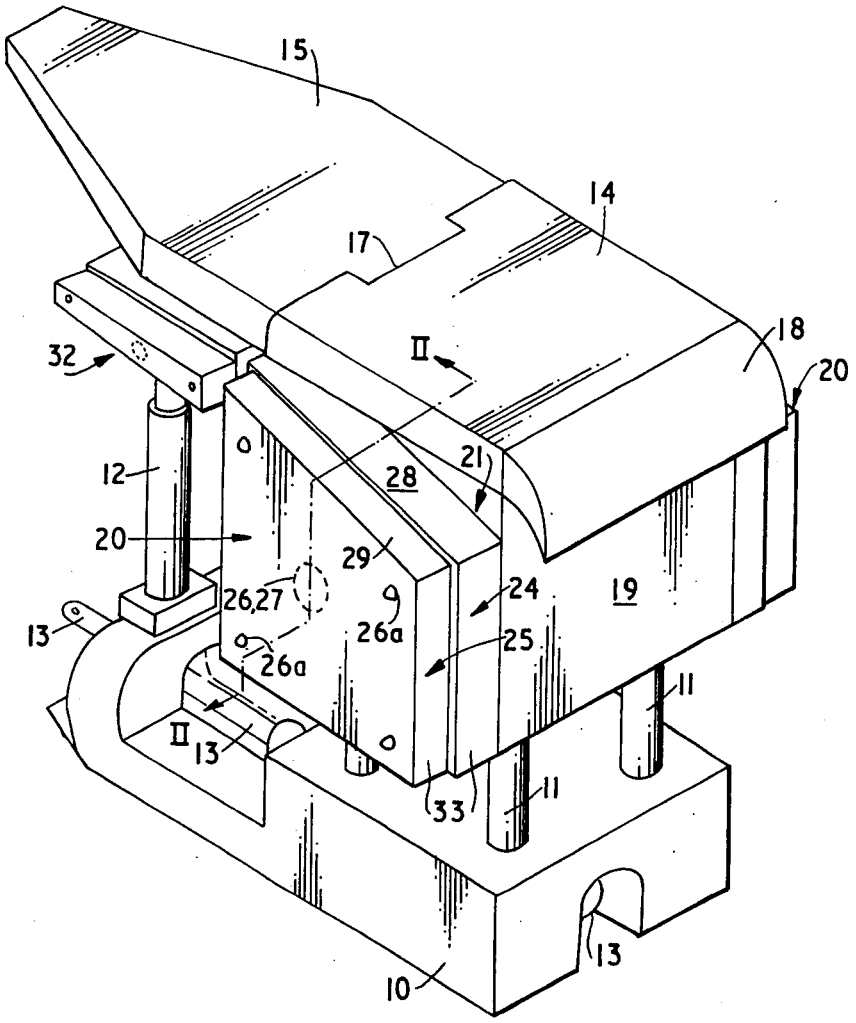
-- FIG.1 --

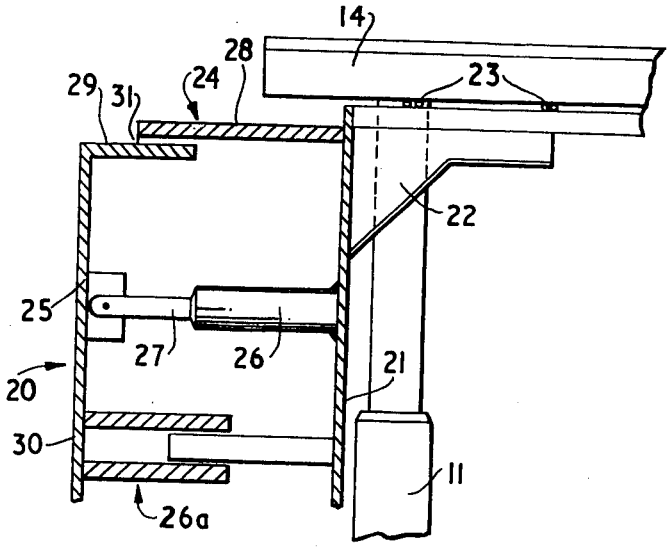
-FIG. 2-
-FIG. 9-
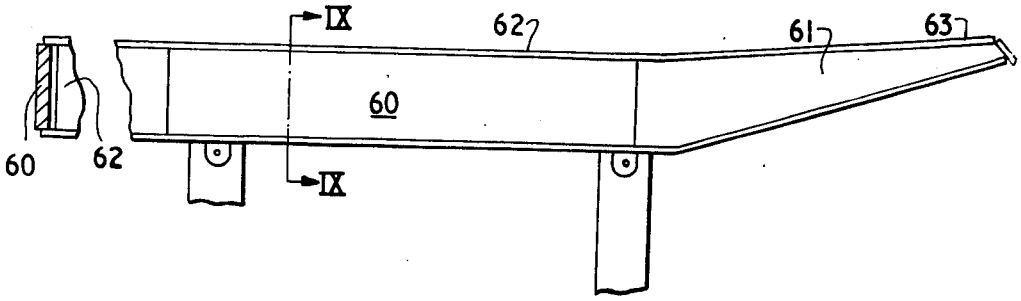
-FIG. 8-

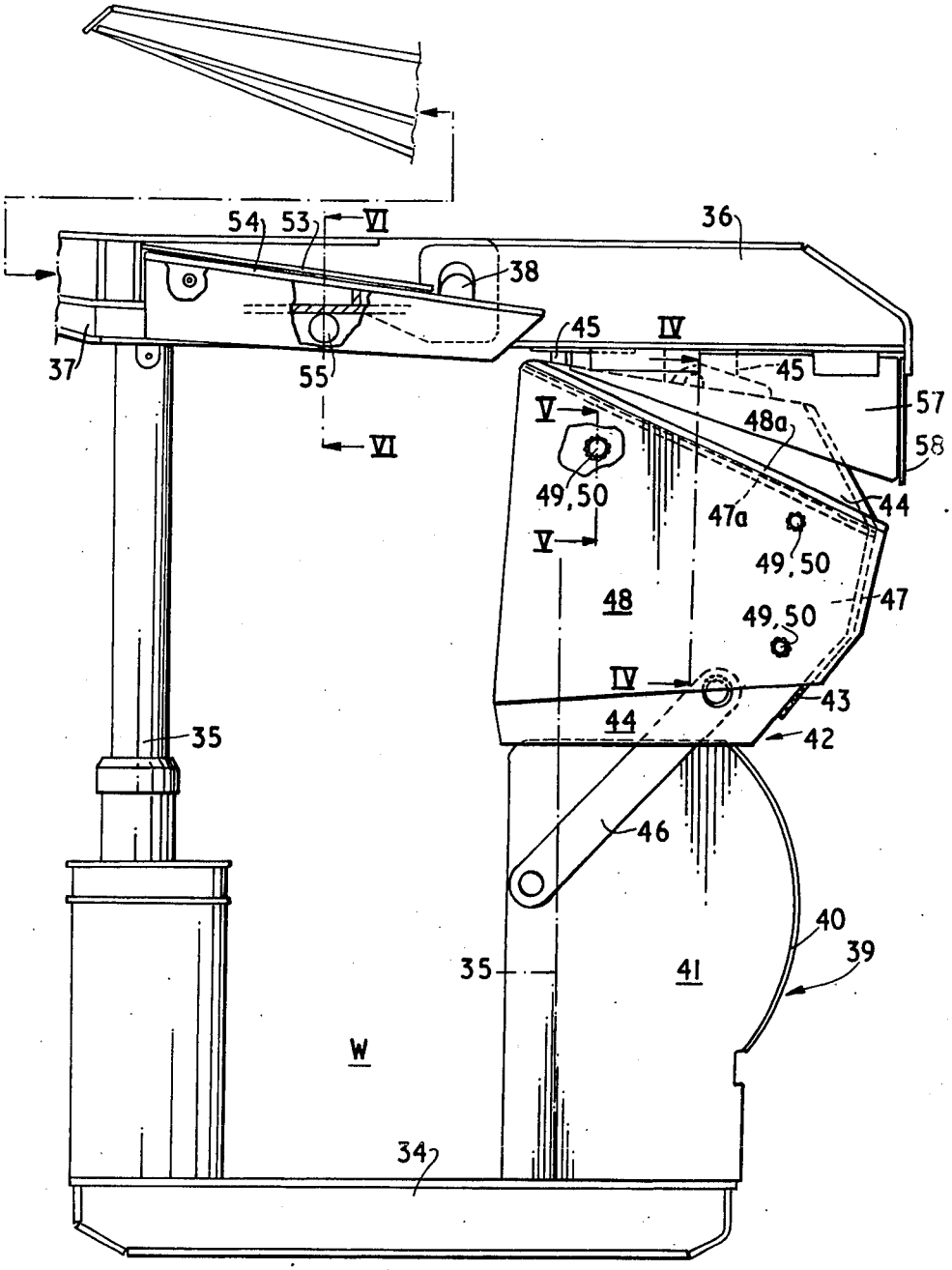
-FIG. 3-

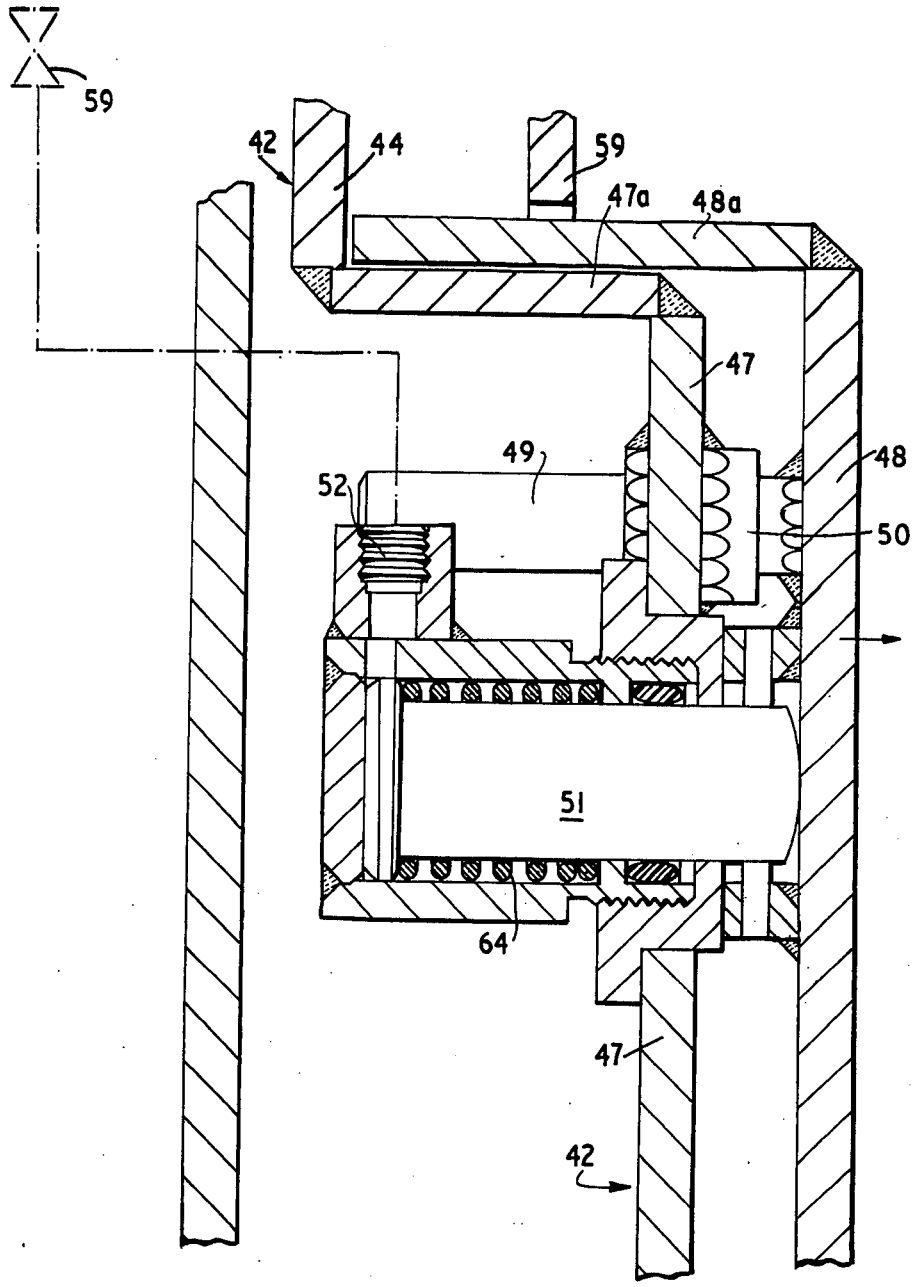
—FIG.4—

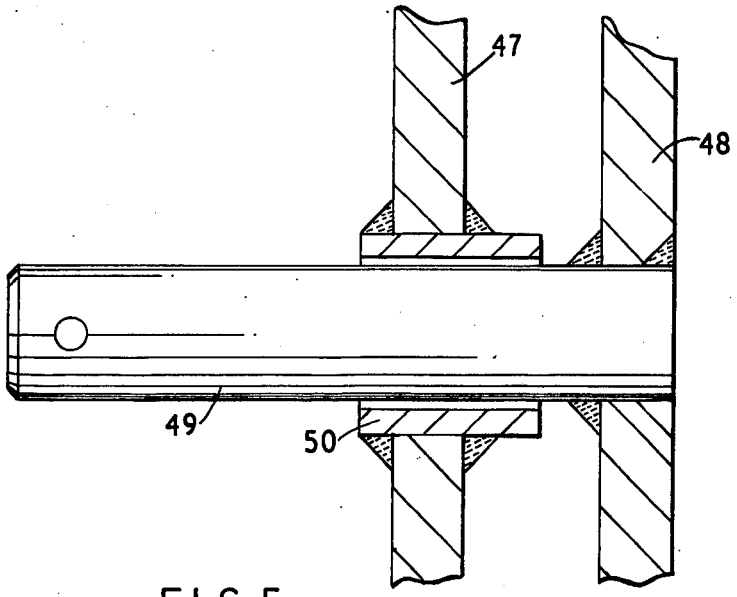
-FIG.5-
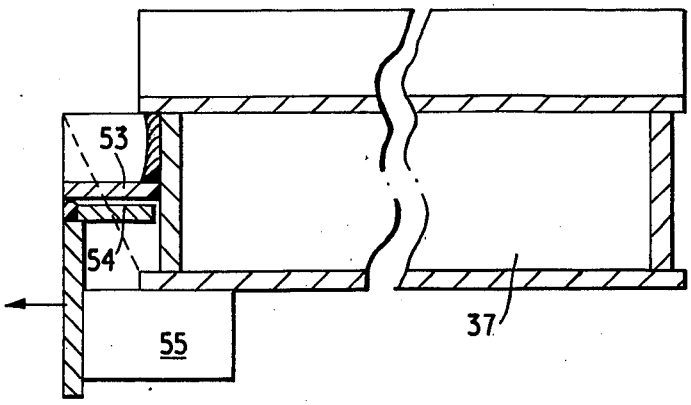
-FIG.6-

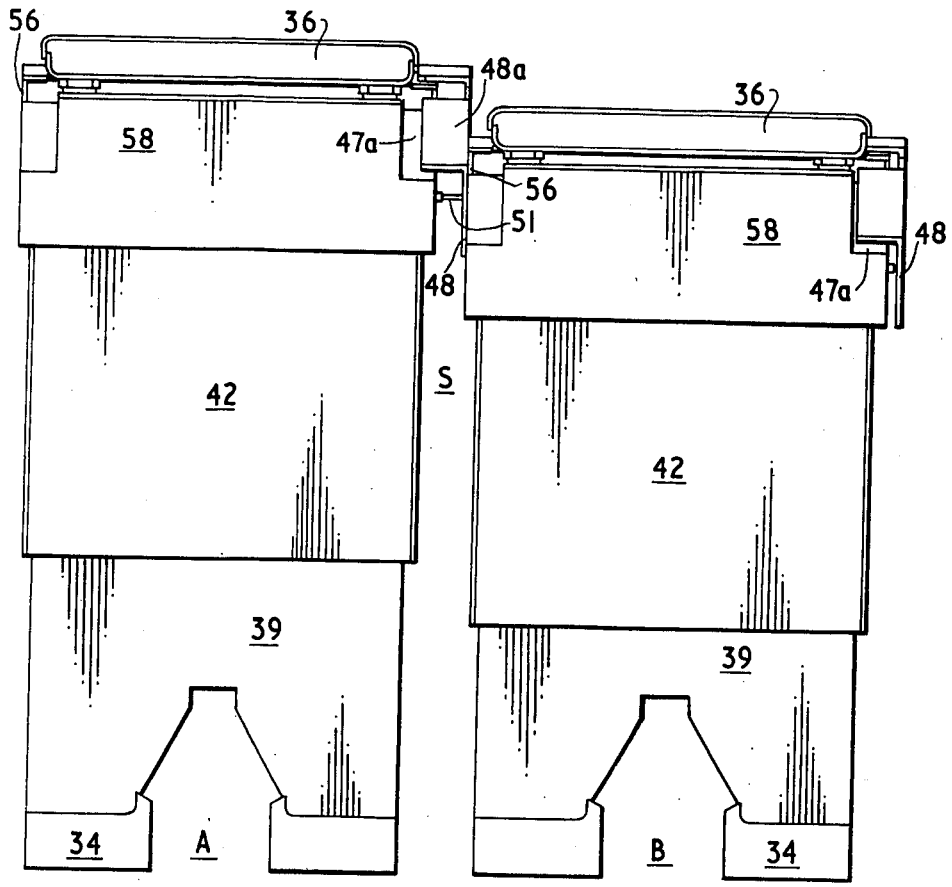
-FIG. 7-

MINE ROOF SUPPORTS

BACKGROUND OF THE INVENTION

This invention is for improvements in or relating to mine roof supports of the kind (hereinafter referred to as the kind specified) comprising a base structure, one or more hydraulically extensible props or legs mounted on said base structure and a roof-engaging structure mounted on said props or legs for application thereby to the roof to be supported. Generally the roof-engaging structure is at least in part in the form of a canopy. When a row of such supports is assembled at a mineral face a walkway is provided, under said canopy, along which miners can travel in comparative safety. To enable the supports to be advanced towards the mineral face, as winning of mineral therefrom proceeds, it is necessary that there should be some clearance or space or freedom for movement between the roof-engaging structures or canopies of neighboring roof supports. There is a risk, therefore, of miners being injured by mineral falling through said clearance or space. One object of the present invention is to provide improved means for avoiding this and which at the same time will not interfere with the advancing of a support.

SUMMARY OF THE INVENTION

According to the present invention there is provided a mine roof support, of the kind specified, having at at least one of its sides a laterally extensible and retractable auxiliary canopy or canopy-like shield and a device for urging and extending said auxiliary canopy or shield laterally outwardly with respect to the support.

When a support is to be advanced the auxiliary canopy or shield is retracted or is free to retract so that it will not interfere, by engagement with a neighboring support, with such advance. On completion of the advance of a support the shield or shields is or are extended so as to contact the roof-engaging structure of a neighboring support, or a similar shield thereon, and provide continuity of support protection, against falling mineral from above and behind, throughout the length of a walkway for miners through a row of roof supports.

The device for urging the shield laterally outwardly may be a pressure-fluid ram which may be double-acting if it is required both to extend and retract the shield. Additionally or alternatively said device may incorporate a spring or springs.

If a pressure-fluid-operated device is used it is preferably adapted to operate at a low pressure so as to minimise friction between the shield and a neighboring support, or a similar shield thereon, when a support is being advanced. The shield may also be designed to provide protection against material falling from behind the support.

Conveniently the shield comprises two members one of which overlies the other, one of said members being attached to the support, and extensible and retractable guide means supporting one of said members from the other, the device for urging and extending the shield laterally being arranged to act between said two members.

In one preferred embodiment of the invention the or each shield or auxiliary canopy comprises the upper walls of two or more members fitted telescopically one within the other, and also adapted to provide a side anti-flushing shield. Conveniently said members are box-like members.

One of said box-like members is attached, preferably by a flexible connection, to the roof-engaging structure of the support and is provided with guide means for the other and laterally extensible and retractable member of the shield. A hydraulic ram is housed within the box-like members and serves to effect said lateral extension and retraction. Said ram may be replaced by a spring if uni-directional urging of the shield outwardly is all that is required.

There may be two or more of said shields at the or each side of a roof support. For example, where the roof-engaging structure of a support comprises a main canopy and a forwardly extending cantilever bar or member hingedly connected thereto, there may be one such shield associated with the main canopy and another associated with the cantilever bar or member.

BRIEF DESCRIPTION OF THE DRAWINGS

The invention will be further described, by way of example, with reference to the accompanying drawings in which:

FIG. 1 is a semi-diagrammatic perspective view of a self-advancing mine roof support incorporating one embodiment of the invention, FIG. 2 is a semi-diagrammatic cross-sectional view on the line II—II of FIG. 1, FIG. 3 is a side elevation of a self-advancing mine roof support incorporating a further embodiment of the invention, FIG. 4 is a cross-sectional view on the line IV—IV of FIG. 3, FIG. 5 is a cross-sectional view on the line V—V of FIG. 3, FIG. 6 is a cross-sectional view on the line VI—VI of FIG. 3, FIG. 7 shows diagrammatically two of the supports of FIG. 3 in side-by-side relationship as they would be positioned, with many other such supports, at a mineral face being mined, FIG. 8 shows, in side elevation, a detail of an abutment plate arrangement which may be provided on one side of the roof-engaging structure of a roof support, and FIG. 9 is a cross-section on the line IX—IX of FIG. 8.

DETAILED DESCRIPTION OF THE PREFERRED EMBODIMENTS

The support shown in FIGS. 1 and 2 comprises a base structure 10 having mounted in it four rearwardly positioned hydraulic props 11 and a forwardly positioned hydraulic prop 12. A double-acting hydraulic ram 13 is incorporated in the base structure 10 and serves to advance the support in the well known way.

The roof-engaging structure of the support comprises a canopy 14, mounted on the props 11 and a cantilever extension bar or member 15 hinged to said canopy at 17 and supported forwardly of said hinge by the prop 12.

It will be noted that the rear of the canopy is downwardly directed, at 18, over a rear anti-flushing shield 19. The shield 19 is attached to the underside of the canopy by hinge or other flexible means and/or a pivoted link arrangement.

At each of its sides the canopy 14 of the support is provided with laterally extensible and retractable side shields 20 hereinafter referred to as auxiliary canopies.

Each of said auxiliary canopies 20 comprises a side-shield member 21 having a bracket 22 flexibly or hingedly attached at 23 to the underside of the canopy 14 and carrying a box-like member 24. Positioned telescopically within the member 24 is a further box-like side-shield member 25 which is extensible and retractable relatively to the member 24 on guide means 26*a.* Such extension and retraction is effected by a double acting hydraulic ram having its cylinder 26 attached to the member 21 and its piston rod 27 connected to the member 25. Valve means (not shown) are provided for controlling the operation of said ram.

It will be noted (see FIG. 1) that the upper walls 28 and 29, of the members 24 and 25, which walls serve as the actual auxiliary canopy, slope downwardly towards the rear of the support. Thus, any mineral falling on the auxiliary canopy is directed to the waste area of the mine working.

The vertical wall 30 of the member 25 serves together with the upper part of the member 21, as a side anti-flushing shield.

Prior to advancing the support the ram 26,27 is retracted so as to draw the member 25 into the member 24 and out of contact with the neighboring support in the row. This operation also serves to dislodge any mineral which may have accumulated at 31 on the upper wall 29 of the member 25.

When the support has been advanced the ram 26,27 is extended so as to bring and continuously urge the member 25 into contact with a corresponding member on a neighboring previously advanced support.

Where the roof supports are positioned on an inclined seam it may only be necessary to retract the member 25 on one side of each roof support because the tendency towards downhill movement of the supports will provide some freedom of movement between them. In similar circumstances it may not be necessary to provide auxiliary canopies 20 on all the roof supports.

The cantilever member 15 is provided on each of its sides with a similarly constructed auxiliary canopy 32 which is flexibly or hingedly attached to said member.

Valve means will, of course, be provided for controlling the pressure-fluid flow of the ram 26,27. Such valve means may be incorporated in the hydraulic system of the support so that the ram 26,27 is automatically retracted or put on open circuit before the advancing ram 13 becomes operative to advance the support.

The rear walls 33 of the members 24 and 25 may be designed to provide rear anti-flushing shields.

The shield 19 may be extended downwardly by the provision of "chain-armour" or other anti-flushing shielding.

The upper walls or canopies proper of the auxiliary canopies 20 and 32 may be arranged to overlap so as to provide continuity in a direction from rear to front of the support.

The self-advancing roof support shown in FIGS. 3 to 6 comprises a base 34 having mounted on it, at the corners of a rectangle, four hydraulically extensible telescopic props which are indicated at 35. At their upper parts the props 35 support a roof-engaging structure comprising a canopy 36 and a forwardly extending roof-engaging bar 37 pivotally connected to said canopy, cantilever fashion, as indicated at 38. The canopy is L-shaped in plan and the rear end of the bar 37 lies within the limbs of the L, three of the props supporting the canopy and the remaining prop the bar 37.

A double-acting hydraulic ram, not shown, is provided in the base 34 for advancing the support in the usual way.

At its rear the support is provided with an anti-flushing shield arrangement to prevent debris from the waste or goaf flushing into the support and obstructing the walkway W along which miners move under the protection of the canopy 36 and roof bar 37. This shield arrangement comprises a lower part 39 rigidly secured to the base 34 and having an arcuate rear wall 40 and side walls 41, and an upper part 42 having a rear wall 43 and side walls 44. The part 42 is hingedly or flexibly attached to the canopy 36, so as to be suspended therefrom, as indicated at 45. The upper shield part 42 is connected to the lower shield part 39 by a link arrangement 46. The anti-flushing shield arrangement so far described is similar to that described in the specification of our United Kingdom Pat. No. 1,124,665 (U.S. Pat. No. 3,483,705).

For the purpose of the present invention one side wall 44 of the upper shield part 42 has a box-like formation as indicated at 47 and shown more particularly in FIG. 4. Positioned telecopically over the box-like formation 47 is a box-like shield member 48 having guide and stop means each comprising a stub shaft 49, on the member 48, which works in a guide bush 50 mounted in the side wall of the box-like formation 47.

Lateral extension of the member 48 relatively to the upper shield part 42 is effected by a hydraulic ram 51 carried by the box-like formation 47 of said upper shield part. The ram 51 has a port 52 for pressure-fluid by which it is caused to urge the member 48 outwardly in the direction of the arrow.

Mounted on one side of the roof bar 37 (see more particularly FIG. 6) is an auxiliary canopy comprising a laterally extending shield member 53 having associated with it a laterally extendable shield member 54. The member 54 is supported from the roof bar 37 by guiding and support means similar to the stub-shaft and bush arrangement (49,50) shown in FIG. 4. Lateral extension of the shield member 54, relatively to the member 53 (i.e., in the direction of the arrow in FIG. 6) is effected by a hydraulic ram 55 carried by and under the roof bar 37.

It will be noted (see FIG. 3) that the top 47*a* of the box-like formation 47, the top 48*a* of the box-like shield member 48, the shield member 53 and the top of the shield member 54 all slope downwardly towards the rear of the support, so as to direct any material falling on to them into the waste or goaf.

FIG. 7 shows diagrammatically and in rear elevation two roof supports, of the character above described with reference to FIGS. 3 to 6, positioned in side-by-side relationship as they would be at a mineral face being mined by the longwall system.

It will be noted that the shield member or auxiliary canopy 48 of the roof support A has been extended by its ram 51 so that it bears and is held firmly against an abutment plate 56 on the support B to provide a canopy over the space S between the two supports. Similarly when the shield member 48 on the support B is extended it will bear firmly against an abutment plate on the next roof support in the series and so on through the row of roof supports. The shield members or auxiliary canopies 54 on the roof bars 37 of the supports will be similarly extended and urged against abutment plates, on their neighboring roof supports, by their rams 55. When a roof support is to be advanced, the rams 51 and 55 of its shield members or auxiliary canopies 48 and 54 are temporarily put on open circuit so that said shield members do not then bear against their abutment plates to such an extent, if at all, as to interfere with the advance of the support.

It will be noted from FIG. 3 that the rear end of the shield member 54 overlies the forward end of the shield member 48*a*. Thus, the laterally extending auxiliary canopies provided by said members cover completely the gap between the roof-engaging structures of neighboring supports.

At its rear end the canopy 36 is provided with side shields 57 and a rear shield 58 which are hinged to the canopy and serve to close the gap between the latter and the upper edge of the shield part 42.

Where the auxiliary canopies are operated by pressure-fluid actuated rams (e.g., the rams 51 and 55) said rams may be linked or connected in the same pressure-fluid circuit as the advancing ram and/or props of the support so that the auxiliary canopies are adjusted automatically during the advance of a support and/or during the extension and/or retraction of the props. For example (see FIG. 4) the port 52 of the rams 51 may be connected to a multi-ported selector valve (indicated diagrammatically at 59) which controls the flow of pressure-fluid to and from the advancing ram and props of the support. Such a valve is described in the specification of our United Kingdom Pat. No. 1,261,129.

The abutment plates (e.g., the abutment plate 56) for the shield members or auxiliary canopies may be resilient. FIGS. 8 and 9 show, by way of example, spring steel abutment plates 60 and 61 provided respectively on the canopy 62 and roof-engaging extension bar 63 of a roof support.

A return spring may be incorporated in the ram 51 as shown in FIG. 4.

The invention may, by suitable adaptation, be applied to a roof support having any number of props.

It will be appreciated that the invention will provide for the auxiliary canopies or canopy and abutment plate of neighboring supports to be kept in contact when required while also allowing for some flexibility during the advance and setting of a support.

While the supports described fulfill the requirements of preventing ingress of debris into the walkway, under friable and dusty roof conditions rubber flaps may be adopted between all moving parts of the box-like telescopic members.

Obviously, numerous modifications and variations of the present invention are possible in light of the above teachings. It is therefore to be understood that within the scope of the appended claims, the invention may be practiced otherwise than as specifically described herein.

I claim:

1. A mine roof support comprising a base structure, hydraulically extensible prop means mounted on said base structure, a roof-engaging structure including a canopy mounted on said prop means and having an upper roof-engaging surface for application thereby to a roof to be supported, a laterally extensible and retractable auxiliary canopy positioned on at least one side of the support below said upper roof-engaging surface, mounting means connecting said auxiliary canopy to said at least one side of said support for permitting pivotal movement of said auxiliary canopy relative to the vertical, and a device for urging and extending said auxiliary canopy laterally outwardly with respect to the support.

2. A mine roof support as claimed in claim 1 wherein the auxiliary canopy comprises two members one of which overlies the other, one of said members being attached to the support, and extensible and retractable guide means supporting one of said members from the other, the device for urging and extending the auxiliary canopy laterally being arranged to act between said two members.

3. A mine roof support as claimed in claim 1 wherein the auxiliary canopy comprises the upper walls of at least two members fitted telescopically one within the other.

4. A mine roof support as claimed in claim 3 wherein said members are box-like members.

5. A mine roof support as claimed in claim 2 wherein said mounting means comprises a hinge or flexible connection.

6. A mine roof support as claimed in claim 4 wherein the device for urging and extending the auxiliary canopy laterally is housed within the box-like members.

7. A mine roof support as claimed in claim 1 wherein the auxiliary canopy has a substantially vertical wall to serve as a side anti-flushing shield.

8. A mine roof support as claimed in claim 1 wherein the auxiliary canopy has a rear wall to serve as a rear anti-flushing shield.

9. A mine roof support as claimed in claim 1 wherein the auxiliary canopy slopes downwardly towards the rear of the support.

10. A mine roof support as claimed in claim 1 wherein the device for urging the auxiliary canopy laterally outwardly comprises a pressure-fluid ram.

11. A mine roof support as claimed in claim 10 wherein said ram is a double-acting ram.

12. A mine roof support as claimed in claim 10 wherein valve means controlling the pressure-fluid flow of said ram is incorporated in the pressure-fluid system of a pressure-fluid advancing means for the support so that said ram is automatically retracted or put on open circuit before said support advancing means becomes operative to advance the support.

13. A mine roof support as claimed in claim 1 wherein the device for urging the auxiliary canopy laterally outwardly incorporates a spring.

14. A mine roof support as claimed in claim 1 wherein the auxiliary canopy is mounted on a rear anti-flushing shield or a part thereof of the support.

15. A mine roof support as claimed in claim 1 and having one such auxiliary canopy at one of its sides and an abutment member, for an auxiliary canopy of a neighboring support, at its other side.

16. A mine roof support as claimed in claim 15 wherein said abutment member is resilient.

17. A mine roof support as claimed in claim 1 wherein the roof-engaging structure includes a forwardly projecting roof bar and wherein there is one such auxiliary canopy on at least one side of both the canopy and said roof bar of the roof-engaging structure.

18. A mine roof support as claimed in claim 17 wherein there is an overlap between the auxiliary canopies.

* * * * *

UNITED STATES PATENT AND TRADEMARK OFFICE

CERTIFICATE OF CORRECTION

PATENT NO. : 4,041,714

DATED : August 16, 1977

INVENTOR(S) : Archelaius Dawson Allen

It is certified that error appears in the above-identified patent and that said Letters Patent are hereby corrected as shown below:

On the title page,
In the heading, before the International Classification, the following should be inserted:

[30] Foreign Application Priority data:

November 23, 1974 United Kingdom 50838/74

Signed and Sealed this

*Twenty-sixth* Day of *July 1983*.

[SEAL]

*Attest:*

GERALD J. MOSSINGHOFF

*Attesting Officer* *Commissioner of Patents and Trademarks*